US006986327B2

(12) United States Patent
May

(10) Patent No.: US 6,986,327 B2
(45) Date of Patent: Jan. 17, 2006

(54) METHOD OF REDUCING SMOKE AND PARTICULATE EMISSIONS FROM STEAM BOILERS AND HEATERS OPERATING ON LIQUID PETROLEUM FUELS

(75) Inventor: Walter R. May, Houston, TX (US)

(73) Assignee: SFA International, Inc., Houston, TX (US)

( * ) Notice: Subject to any disclaimer, the term of this patent is extended or adjusted under 35 U.S.C. 154(b) by 75 days.

(21) Appl. No.: 10/424,414

(22) Filed: Apr. 28, 2003

(65) Prior Publication Data

US 2004/0011302 A1 Jan. 22, 2004

Related U.S. Application Data

(63) Continuation-in-part of application No. 10/417,547, filed on Apr. 17, 2003, now Pat. No. 6,881,235, which is a continuation-in-part of application No. 10/192,261, filed on Jul. 10, 2002, now Pat. No. 6,866,010.

(60) Provisional application No. 60/373,249, filed on Apr. 17, 2002, provisional application No. 60/304,579, filed on Jul. 11, 2001.

(51) Int. Cl.
*F02B 75/12* (2006.01)

(52) U.S. Cl. ..... 123/1 A

(58) Field of Classification Search ..... 123/1 A; 48/191

See application file for complete search history.

(56) References Cited

U.S. PATENT DOCUMENTS 3,891,401 A * 6/1975 Watson et al. ..... 44/359
5,824,209 A * 10/1998 Arand et al. ..... 208/135

FOREIGN PATENT DOCUMENTS

GB 2248068 A * 3/1992

OTHER PUBLICATIONS

Edited by Eliot, Boiler Fuel Additives for Pollution Reduction and Energy Savings, 1978, pp. 67-72.
Rising, B., Particulate Emission Reduction Using Additives, Technical Paper TP-98010, Jan. 9, 1998, Westinghouse Power Corp., Orlando, FL 32826-2399.
Dr. Walter May, Combbustion Turbine Exhaust Particulate Emission Reduction: A Mechanistic Discussion, dated Jun. 2002.

* cited by examiner

*Primary Examiner*—Willis R. Wolfe
*Assistant Examiner*—Katrina B. Harris
(74) *Attorney, Agent, or Firm*—Karen B. Tripp

(57) ABSTRACT

A method of reducing smoke and particulate emissions from steam boilers and process heaters operating on liquid petroleum fuel by adding a fuel additive which contains an oil-dispersible iron compound and an over-based magnesium compound to liquid petroleum fuel.

13 Claims, No Drawings

METHOD OF REDUCING SMOKE AND PARTICULATE EMISSIONS FROM STEAM BOILERS AND HEATERS OPERATING ON LIQUID PETROLEUM FUELS

RELATED APPLICATIONS

This application is a continuation in part of the application with the U.S. Ser. No. 10/192,261, filed Jul. 10, 2002, now U.S. Pat. No. 6,866,010 which claimed priority to 60/304,579 filed Jul. 11, 2001 and a continuation in part of the application with the U.S. Ser. No. 10/417,547, filed Apr. 17, 2003, now U.S. Pat. No. 6,881,235 which claimed priority to Ser. No. 60/373,249, filed on Apr. 17, 2002, which hereby are incorporated by reference in their entirety.

BACKGROUND OF THE INVENTION

1. Technical Field

The present invention relates in general to a fuel additive that is a combustion catalyst for liquid petroleum fuel and in particular to a catalyst containing an over-based magnesium compound combined with a dispersible or soluble iron compound. Such catalyst is particularly useful in heaters using liquid fuel.

2. Description of the Prior Art

Concerns for the environment have led to more stringent restrictions on emissions from combustion of hydrocarbons. Similarly, fuel efficiency has developed into a significant concern. Many techniques have been explored to reduce particulate emission, such techniques having various levels of success and various side effects. Emission controls in engines and other uses have been implemented by injection timing, addition of water, exhaust gas recirculation, fuel additives, compression ratio, pilot injection, combustion chamber design and electronic control of the fuel injection. The use of fuel additives to reduce particulate emissions in hydrocarbon combustion applications has been effective. In addition to tetraethyl lead for use in gasoline engines, several elements are known to have combustion catalyst characteristics useful for liquid hydrocarbon combustion chambers. Examples, are manganese, iron, copper, cerium, calcium and barium. Each of these elements has advantages and disadvantages in particular applications.

In the past, iron has been evaluated for catalyst properties, for example, in the form of bis-cyclopentadienyl iron (0) or ferrocene. Drawbacks of ferrocene include limited solubility in liquid hydrocarbons, toxicity, and expense as an additive. Other iron compounds in oil dispersible form or as dispersions have been evaluated with similar drawbacks of limited effectiveness and expense. One drawback in the use of iron compounds alone is that the iron compounds can catalyze formation of SO— which forms sulfuric acid at the dew point in the exhaust.

Other additives evaluated for use in liquid hydrocarbon have drawbacks including insolubility in hydrocarbons or lacking in the ability to create a dispersion in hydrocarbon liquid. Those additives that are water-soluble pose additional risks to the environment as spills or leaks from underground tanks could be hazardous to the environment.

In addition to iron, useful first row transition metals from the periodic table include manganese and copper. Also, various alkaline earth metals (barium, calcium) and others such as cerium, platinum and palladium have been tested. Manganese is used as a combustion catalyst in boilers with residual oil that often contains fuel contaminants, such as vanadium. Platinum and palladium, generally found in catalytic converters, are quite expensive. Manganese, when used alone, also forms low melting deposits and negates effects of magnesium on control of vanadium/sodium/calcium/potassium deposits. Iron catalyzes sulfur trioxide formation from sulfur dioxide increasing "cold end" corrosion (exhaust area) and sulfuric acid "rain" problems. Copper is less effective than either iron or manganese. Calcium forms tenacious deposits with other contaminant metals. Barium forms toxic salts. Cerium is not considered effective because of its higher elemental weight. These metals have been demonstrated to reduce smoke by no more than 50% at concentrations of up to about 50 PPM on a weight/weight basis by Environmental Protection Agency Test Method 5 (EPC M-5). While these metals have been evaluated in turbines and boilers, octane number is not at issue in this environment. Stability of the metal molecules is also not at issue and therefore not tested in boiler and turbines.

The effects of various metals listed above are known to improve combustion in boilers and combustion turbines and metals but these metals are known to vary ash quality. Tests run by this inventor indicate that improvement in emission controls can be achieved through the use of a mixture of magnesium and iron in a ratio of about 5 parts magnesium to about 1 part by weight of iron. While some reduction in emissions from liquid hydrocarbon combustion was measured with this mixture, the reductions were low.

Over-based magnesium (Mg) compounds are known in the art for converting trace metal contaminants into high melting compounds and reducing deposits in combustion turbine engines operated by liquid petroleum fuels containing trace metal contaminants such as vanadium, lead, sodium, potassium and calcium. These contaminants form low melting corrosive deposits on hot metal parts in reciprocating engines, such as low-speed marine diesel engines. Magnesium is known to form high-melting salts with vanadium, sodium and other fuel contaminants. As a result, over-based magnesium compounds are used alone as fuel additives for compression-ignited reciprocating engines to reduce the effects of these contaminants. For example, an over-based magnesium compound has been used alone in a Wartsilla V32 18 cylinder 8 MW stationary diesel engine, to alleviate the effects of deposits and corrosion from the residual oil fuel used. However, there are no known magnesium-containing fuel additives for gasoline engines, which reduce smoke and particulate emissions.

A fuel additive that includes a combustion catalyst to reduce smoke and particulate emissions from equipment that burns liquid hydrocarbon fuels would be advantageous. A dispersible iron additive that remains stable during the combustion process would also be advantageous. While progress has been made in the development of additive that act to reduce emissions by a small amount, a fuel additive that results in substantial reduction of emissions would be advantageous.

SUMMARY OF INVENTION

The present invention includes a method and fuel additive for reducing smoke and particulate emissions from heaters operating on liquid petroleum fuel. Examples of such heaters include steam boilers and process heaters. A method is described for reducing smoke and particulate emissions from an exhaust of heating equipment. Heating equipment has a combustion chamber operating on a liquid petroleum fuel. One embodiment of the invention includes adding a first catalyst to the combustion chamber during combustion. The first catalyst contains an iron (Fe) compound in an amount operable to reduce emissions by at least 50% as compared to the emissions produced by combustion of the same liquid petroleum fuel without the addition of the first catalyst. A second catalyst containing over-based magnesium is also added to the combustion chamber during combustion. Such additions can be achieved in many ways. One method includes introducing the first catalyst into the combustion chamber through a first inlet port. The second catalyst is added into the combustion chamber through a second inlet port. One or both of the catalysts can be added separately from the liquid petroleum fuel. Another preferred method of introducing the first and second catalysts into the combustion chamber include introducing the catalysts together through the first inlet port. Yet another method of introducing the first catalyst and the second catalyst includes adding the catalysts to the liquid petroleum fuel prior to the introduction of the liquid petroleum fuel into the combustion chamber. This creates an enhanced liquid petroleum fuel. This enhanced liquid petroleum fuel is then introduced into the combustion chamber.

One preferred iron compound of the invention includes an oil-dispersible iron compound. An oil-dispersible iron compound is one in which the iron disperses as particles within solution, partially dissolves within solution, completely dissolves within solution or forms some similar combination that allows the iron compounds to disperse within a carrier solution. Examples of some preferred oil-dispersible iron compound include ferric naphthenate, iron naphtenate salt or a dispersion of iron oxide particles stabilized in an organic carrier.

A preferred embodiment of the invention includes establishing the ratio of catalyst in the range of about 3 to 8 parts iron per about 1 part magnesium, by weight. A further preferred embodiment includes establishing the ratio in the range of about 4 parts to about 7 parts iron per about 1 part magnesium, by weight. An alternate embodiment includes establishing the ration at about 5 parts iron per about 1 part magnesium, by weight. Testing conducted on ratios of iron to magnesium on various applications indicates positive emission reduction benefits from the respective ranges.

An additional preferred embodiment includes the liquid petroleum fuel with the iron content preferably in the range of 30–70 PPM by weight with 50 PPM being particularly preferred. This level shows significant emission control over various ranges of ratios. One preferred embodiment includes the addition of the first and second catalyst in amounts effective to reduce the smoke and particulate matter in the exhaust gas by at least 75 percent by weight in comparison to the emissions produced by combustion of liquid petroleum fuel without the first catalyst and the second catalyst. In certain instances, reduction of emissions was observed in excess of 80% and even 90%.

The method of the current invention is useful for any heater that operates on liquid petroleum fuel is a heater. Examples of such equipment include steam boilers, industrial process heaters, refinery process heaters, industrial package-type steam boilers, utility field-directed steam boilers and the like. Secondary combustion chambers of turbines are also included, such as the supplemental firing chamber in a heat recovery steam generator.

Use of the additive of the invention in hydrocarbons to be combusted also is a method of reducing NOx emissions from hydrocarbon-burning processes.

DETAILED DESCRIPTION OF THE PREFERRED EMBODIMENT OF THE PRESENT INVENTION

It has been shown that iron behaves as a true catalyst based on kinetic theory. In related works of this author, including U.S. patent application Ser. No. 10/192,261, it has been found that oil-dispersible iron combined with oil-dispersible magnesium is a very effective combustion catalyst in compression-ignited (Diesel) reciprocating engines. The synergistic mixture of metals results in suppression of hydrocarbons in the exhaust (soot or smoke) and 12 to 20% increase in fuel efficiency. It has been determined that this novel combination of iron and magnesium in hydrocarbon liquids results in suppression of the formation of iron sulfides. The iron compound employed in this product does not disassociate to form iron sulfides. This observation is entirely unexpected as iron compounds typically exhibit negative side effects as discussed above. It appears that catalysis occurs from release of energy by electrons decaying from highly energized to degenerate orbitals. This is observed in the emission spectra of the element. An examination of the emission spectra of iron and magnesium demonstrates a reinforcement of the energy by non-duplicated primary spectra lines. It is believed that the mechanism of catalysis is that the reaction of hydrocarbon with oxygen to form carbon dioxide and water is rapidly quenched by dilution with air and reduced temperature. The energy from decaying electrons in the metal catalyst re-energizes the reaction process so that combustion is completed. This results in lower temperatures of operation and reduced NOx formation as well as the reduction of particulate emissions.

Interestingly, prior test of magnesium and iron in a solution of 5.5% magnesium and 1.1% iron by weight led to very minor reduction of particulate emissions. Due to the relative ratios of the magnesium to iron, the total amount of iron being added to the liquid hydrocarbon fuel was also low. As iron typically forms iron sulfides, it is generally deemed desirable to maintain the iron at very low amounts. Based on the small reduction of emissions using iron and magnesium, the substantial reduction in omissions observed in the current invention is unexpected. These reductions have been measured from 50% to above 90% as compared to liquid hydrocarbon without magnesium and iron. This is substantially higher than other known additives.

The preferred iron compound used in the formulation is ferric naphthenate. Naphthenic acid is an aliphatic carboxylic acid with a phenyl group on the end of the chain opposite the carboxyl group. Iron oxide is reacted therewith to create ferric naphthenate. The unsaturated ring will cause higher electron density in the carboxyl group with a lower ionization constant. The result is that the iron naphthenate does not disassociate readily in a hydrocarbon system, even in the presence of a strong Lewis acid such as a sulfide ion. The addition of this additive allows the use of cheaper grades of gasoline as these gasolines can be significantly improved and made useable by such addition.

The very high activity of the iron-magnesium combination was entirely unexpected, especially at the 50 PPM iron (Fe) treatment level. An examination of the spectra of magnesium, iron, copper and manganese reveals that the spectra lines of magnesium compliment the spectra lines of iron. There are no duplicates or reinforcements. The magnesium spectra, by itself, do not yield energy in the areas that will continue burning of hydrocarbons after the temperature is quenched. However, it is believed that the magnesium spectra are synergistic with the spectra of iron to give an energy quanta (packets) that support and continue reaction of hydrocarbon with oxygen after the temperature is quenched below temperatures that would normally support combustion. Therefore, magnesium supports the catalytic effect of iron in a synergistic fashion that results in the additive being much more effective than iron alone.

The composition of one embodiment of this invention is an oil-dispersible iron compound and an over-based magnesium compound. This composition catalyzes combustion of liquid petroleum fuels when added to such fuels. The catalyzed combustion results in improved efficiency and reduced emissions.

The additive has been tested and found to be effective with iron to magnesium around a ratio of 5:1 by weight. Alternate embodiments of the composition include a fuel additive, which contains about 3.0 to 8.0 parts iron, by weight for about 1.0 part magnesium, by weight. Preferably, from 4.0 to about 7.0 parts iron, by weight, for 1.0 part magnesium, by weight is used. More preferably, from about 5.0 parts iron, by weight, for about 1 part magnesium, by weight is used.

The preferred over-based magnesium compounds of this invention are selected from carboxylate, sulfonate, acetic and mixtures thereof. The term "over-based" refers to the excess amount of base as compared with the acid of the solution, the acid being provided by the carboxylic acid, sulfonic acid or acetic acid of the preferred embodiment. The over-based magnesium compound preferred for this invention is magnesium oxide in a stable colloidal dispersion, the magnesium oxide being in such a proportion as to be greater than the amount that the acid of the additive solution could neutralize.

EXAMPLE 1

The fuel additive composition can be formulated as a concentrate, which preferably contains about 5.5% iron, by weight, and about 1.1% magnesium, by weight. Dilutions of this concentrate can be made for convenience of use.

For an iron concentration of 50 PPM Fe, the amount of oil-dispersible iron needed is about 4 gm. Fe. Sufficient oil-dispersible iron and over-based magnesium compounds are added to the fuel so that about 4 gm. of iron are added for about 100 liters of fuel.

Other volumes and/or weights may be used to treat a given volume and/or weight of fuel with a variety of concentration of the fuel additive.

EXAMPLE 2

The oil-dispersible iron compound of this invention may be prepared in a single batch in laboratory quantities. The apparatus required is a 3-Neck round bottom 1,000 ml. flask, heating mantle, temperature controller, 0-400° C. thermometer, stirrer center mounted with a motor and controller, condenser and vacuum pump with trap.

The reactants are as follows:

| | |
|---|---|
| Iron Oxide | 79 gms. |
| Carboxylic acid (MW > 200) | 720 gms |
| High Boiling Process Solvent | 215 gms |

The apparatus is assembled with the thermometer in one outside neck and stirrer in the inner. Connect a condenser to the flask in the reflux position. Add high boiling solvent, carboxylic acid (>200 MW) to the reactor. Heat to 90° C. Add iron oxide and heat to 110° C. Add carboxylic acid (>45 MW) and heat to 140° C. Reflux for one hour. Remove water of reaction with the carboxylic acid. Heat to >200° C. until high boiling solvent and water is removed. When water stops evolving, place the condenser in the distillation position, apply vacuum and remove remaining solvent. Return high boiling solvent and/or HAN or No. 2 fuel to reach desired iron concentration.

EXAMPLE 3

The over-based magnesium compound of this invention may be prepared in a single batch in laboratory quantities. The apparatus required is a 3-Neck round bottom 1,000 ml. flask, heating mantle, temperature controller, 0–400° C. thermometer, center-mounted stirrer with a motor and controller, condenser and vacuum pump with trap.

The reactants are as follows:

| | |
|---|---|
| Magnesium hydroxide | 195 gms. |
| Sulfonic acid (MW > 200) | 37 gms. |
| Carboxylic acid (MW > 200) | 99 gms. |
| Carboxylic acid (MW > 45) | 2 gms. |
| High Boiling Process Solvent | 215 gms. |
| High aromatic solvent | 138 gms. |

The apparatus is assembled with the thermometer in one outside neck, stirrer in the center. Connect the condenser to the flask in the reflux position. Add high boiling solvent, carboxylic acid (>200 MW) and sulfonic acid to the reactor. Heat to 90° C. Add magnesium hydroxide and heat to 110° C. Add carboxylic acid (>45 MW) and heat to 140° C. Reflux for one hour. Remove water of reaction with the carboxylic acids. Heat to >280° C. until high boiling solvent and water is removed. When water stops evolving, place the condenser in the distillation position, apply vacuum and remove remaining solvent. Return high boiling solvent and/or HAN or No. 2 fuel to reach desired magnesium concentration.

While the degree of purity of the additive has not been examined for effect, the additive was created as described above to achieve high purity for purposes of scientific testing. The described method of creating the ferric naphthenate was developed as part of the creation of the fuel additive of the invention and is novel.

The present invention has several advantages. In addition to the reduction of emissions, this invention avoids the use of toxic metals such as lead in engine exhausts. Ferric oxide resulting from combustion of the additive is rust, a widely prevalent material in nature that is totally benign to biological life forms. Ferric sulfide precipitate is also avoided. The iron naphthenate and the magnesium oxide combination is non-toxic and non-carcinogenic in normal applications. While ingestion and prolonged contact with skin is not recommended, the material can be washed off skin with soap and water, and safely eliminated from the body with emetics. Other methods of practicing the invention would be other chemical forms of the product and introducing to the fuel through different techniques.

While the present invention has been described and/or illustrated with particular reference to combustion catalyst for heaters it is noted that the scope of the present invention is not restricted to the particular embodiment(s) described. It should be apparent to those skilled in the art that the scope of the invention includes the use of the catalyst in other similar applications than those specifically described. Moreover, those skilled in the art will appreciate that the invention described above is susceptible to variations and modifications other than those specifically described. It is understood that the present invention includes all such variations and modifications which are within the spirit and scope of the invention. It is intended that the scope of the invention not be limited by the specification, but be defined by the claims set forth below.

It is claimed:

1. A method of reducing smoke and particulate emissions from an exhaust of heating equipment having a combustion chamber operating on a liquid petroleum fuel, comprising the step of:

adding a first catalyst to the combustion chamber during combustion, the first catalyst comprising an iron compound in an amount such that the liquid petroleum fuel contains at least about 30 PPM to about 70 PPM of iron, based on weight, after adding the first catalyst; and adding a second catalyst to the combustion chamber during combustion, the second catalyst comprising an over-based magnesium compound, such that a ratio of the amount of iron added to the combustion chamber to an amount of magnesium is from about 3 parts to about 8 parts iron per about 1 part magnesium, by weight.

2. The method of claim 1 wherein the first catalyst is added into the combustion chamber through a first inlet port and the second catalyst is added into the combustion chamber through a second inlet port.

3. The method of claim 1 wherein the first catalyst and the second catalyst are added into the combustion chamber through a first inlet port.

4. The method of claim 1 wherein the first catalyst and the second catalyst are added to the liquid petroleum fuel prior to the introduction of the liquid petroleum fuel into the combustion chamber.

5. The method of claim 1 wherein the iron compound is an oil-dispersible iron compound.

6. The method of claim 5 wherein the oil-dispersible iron compound comprises ferric naphthenate, iron naphthenate salt or a dispersion of iron oxide particles stabilized in an organic carrier.

7. The method of claim 1 wherein the ratio is from about 3 parts to about 8 parts iron per about 1 part magnesium, by weight.

8. The method of claim 1 wherein the ratio is from about 4 parts to about 7 parts iron per about 1 part magnesium, by weight.

9. The method of claim 1 wherein the ratio is about 5 parts iron per about 1 part magnesium, by weight.

10. The method of claim 1 wherein the liquid petroleum fuel contains about 50 PPM of iron, based on weight, after adding the first catalyst.

11. The method of claim 1 wherein the smoke and particulate matter in the exhaust gas is reduced by at least 75 percent by weight relative to the emissions produced by combustion of liquid petroleum fuel without the first catalyst and the second catalyst.

12. The method of claim 1 wherein the equipment operating on liquid petroleum fuel is a heater.

13. The method of claim 12 wherein the equipment operating on liquid petroleum fuel is a steam boiler.

* * * * *